United States Patent [19]

Hibell et al.

[11] 4,398,182

[45] Aug. 9, 1983

[54] ELECTROMAGNETIC HORN

[75] Inventors: Ernest G. Hibell; Raymond West, both of Birmingham, England

[73] Assignee: Lucas Industries Limited, Birmingham, England

[21] Appl. No.: 243,478

[22] Filed: Mar. 13, 1981

[30] Foreign Application Priority Data

Mar. 21, 1980 [GB] United Kingdom ..... 8009715

[51] Int. Cl.[3] ..... G08B 3/10

[52] U.S. Cl. ..... 340/388; 340/391; 340/402

[58] Field of Search ..... 340/388, 389, 390, 391, 340/404, 402

[56] References Cited

U.S. PATENT DOCUMENTS

| | | | |
|---|---|---|---|
| 1,789,947 | 1/1931 | Scofield et al. | 340/388 |
| 3,886,546 | 5/1975 | Ueda | 340/388 |
| 4,116,158 | 9/1978 | Warnod | 340/388 X |

*Primary Examiner*—John W. Caldwell, Sr.
*Assistant Examiner*—Daniel Myer
*Attorney, Agent, or Firm*—Trexler, Bushnell & Wolters, Ltd.

[57] ABSTRACT

An electromagnetic horn has a diaphragm, tone disc, spacer and mass which are clamped together between an abutment shoulder and an annular rib on an internally screw-threaded sleeve, the annular rib being produced by deformation of the sleeve after the aforesaid parts have been mounted on the latter. A screw-threaded rod extending from the armature is engaged in the sleeve. Tuning of the horn can be effected by rotation of the rod without the need either to release and then retighten any locknuts or to deform the body. For ease of assembly of a contact breaker assembly into the horn body, a first arm carrying a first contact is mounted at one of its ends in the body. A second arm carrying a second contact is mounted on the first arm but is electrically insulated therefrom. The second arm has an extension abutting a contact stud fixed in the body. An adjuster is engaged with the other end of the first arm. The second arm can be assembled on the first arm before securing of the assembly in the body.

8 Claims, 3 Drawing Figures

ELECTROMAGNETIC HORN

This invention relates to an electromagnetic horn and is particularly, but not exclusively, concerned with an electromagnetic horn for use as an audible warning device on a motor vehicle.

Such an electromagnetic horn typically comprises a hollow body within which an electrical coil is provided, and a diaphragm which is secured about its periphery to the body. The diaphragm is connected with an armature which extends into the coil. In order to obtain the required tone, it is necessary after assembly of the horn to ensure that the armature is correctly positioned in the coil so that the required air gap is provided between the armature and a core of the coil when the coil is de-energised. In one known form of electromagnetic horn, the armature has a screw-threaded rod which extends axially therefrom. The screw-threaded rod has a mass which is screw engaged therewith which lies against the underside of the diaphragm, the rod passing through a central aperture in the diaphragm, through a plurality of spacing washers and through a central aperture in a tone disc. The assembly of tone disc, spacing washers, diaphragm, and mass are clamped together by means of a lock-nut which is engaged with the free end of the screw-threaded rod. The screw-threaded rod is slotted at its free end which is disposed externally of the body in the completed horn.

In order to adjust the air gap between the armature and the core after assembly, the screw-threaded rod has to be rotated and this is effected using a screwdriver engaged in the slotted end of the rod. However, before rotation can be effected, the lock-nut has to be slackened and the screw-threaded rod adjusted until the required tone is obtained. However, it is very easy to upset the setting of the screw when re-tightening the lock nut and so tuning of the horn by setting the required air gap may necessitate more than one operation since it may be necessary to re-loosen the lock-nut and effect further adjustment of the rod. In another form of known construction, the armature is provided with a plain stem which passes through the central aperture in the diaphragm, through the tone disc and through a load spreading washer and the assembly of armature, diaphragm and tone disc is clamped by upsetting the free end of the stem so as to spread it over the washer. Thus, no adjustment of the armature relative to the diaphragm is possible with this construction. However, with this form of construction, adjustment of the air gap is effected by deformation of the body which, in effect, moves the core relative to the armature. However, with this construction, it is not always possible to obtain the required air gap since the body inevitably has a certain springiness and so there will be a certain amount of springback of the body after deformation. This may mean that a further body deforming operation is required to set the required air gap.

It is an object of one aspect of the present invention to provide an improved form of electromagnetic horn which facilitates adjustment of the air gap after assembly and which is better suited to automated setting of the air gap than the above described first prior art embodiment using a locking nut.

According to one aspect of the present invention, there is provided an electromagnetic horn comprising a hollow body, an electrical coil mounted in the body, an armature extending into the coil, a screw-threaded rod extending from the armature, a diaphragm secured around its periphery to the body and having a central aperture, a mass having an aperture therethrough in alignment with the aperture in the diaphragm, a sleeve extending through the apertures in the diaphragm and the mass and having an external, laterally projecting abutment shoulder at one end thereof, the sleeve also being provided with means for securing the diaphragm and the mass together by clamping the diaphragm and the mass between the abutment shoulder and said means, and the screw-threaded rod being screw-engaged in the sleeve whereby adjustment of the armature relative to the coil for air gap-setting purposes can be effected by rotation of the screw-threaded rod.

With an electromagnetic horn of the type requiring a tone disc, it is preferred to mount the tone disc and a spacer on the sleeve between the abutment shoulder and the diaphragm.

Although the securing means may take the form of external screw-threading on the sleeve which engages internal screw-threading in the aperture through the mass, it is highly preferred for the securing means to comprise a portion of the sleeve which is deformed outwardly after assembly of the diaphragm and mass thereon.

With such a construction, it is preferred for the deformation to take the form of an external annular rib which is preferably engaged against an abutment surface in or on the mass.

The screw-threaded rod may have screw threads of the self-tapping type so that, before engagement of the rod in the sleeve, the sleeve may be unscrew-threaded and the threads cut by the self-tapping screw. This arrangement has the advantage that there will be a sufficiently tight engagement between the rod and the sleeve that there is little risk of the air gap setting changing in service. However, if an internally screw-threaded sleeve is employed, it may be preferred to employ a thread locking composition after the air gap has been set in order to ensure that the rod does not rotate relative to the sleeve in service.

The above-described horn will, of course, be provided with a contact breaker assembly, as is usual with electromagnetic horns. A known form of contact breaker assembly comprises a first, relative rigid arm which is mounted at one of its ends in the body by means of a rivet which also secures a terminal externally of the body. This terminal is for supply purposes and is electrically insulated from the body. With such a construction, the same rivet also supports a second arm which is more resilient than the first arm. This second arm is electrically insulated from the body as well as from the first arm by being sandwiched between a pair of electrically insulating members, the second arm being disposed between the first arm and the body. The first and second arms carry respective first and second contacts which, when the coil is de-energised, are in mutual engagement. A part of the second arm is disposed in the path of movement of a part which moves with the assembly of armature and diaphragm in use so that the first and second contacts are separated during movement of the armature. This breaks the current to the coil and allows the armature to be released and the inherent resilience of the diaphragm serves to return the armature to its original position. With such a construction, the lead from one end of the coil is trapped underneath the second spring arm when the rivetting operation is performed to secure the first and second arms relative to the body. The circuit to the coil is completed by way of a second terminal disposed externally of the body and projecting internally for attachment to the other lead from the coil. With such a contact breaker assembly, the assembly operations are relatively troublesome as it has to be ensured that the relatively large number of parts are corrected located before the rivetting operation can be effected.

It is an object of another aspect of the present invention to obviate or mitigate this disadvantage.

According to another aspect of the present invention, there is provided an electromagnetic horn comprising a hollow body, an electrical coil mounted in the body, an armature mounted in the body, a diaphragm connected with the armature for movement thereby, and a contact breaker assembly mounted in the body, said contact breaker assembly comprising first and second contacts, a first electrically conductive arm which (a) is secured at one of its ends to the body so as to be electrically insulated therefrom, (b) is engaged at its other end with an adjuster, (c) has an intermediate portion which carries the first contact, and (d) is electrically connected with one end of the coil, and a second electrically conductive arm which (a) is mounted on the first arm so as to be electrically insulated therefrom, (b) carries the second contact, (c) is arranged to be flexed during movement of the armature to move the second contact relative to the first contact, and (d) is provided with an extension which is resiliently urged into engagement with an electrically conductive element fixed relative to the body whereby, in use, the electrical circuit through the coil is completed by the electrically conductive element and said extension of the second arm.

This arrangement allows the first and second arms to be assembled together before the assembly is mounted in the body. Securing of the first arm to the body automatically brings the extension of the second arm into engagement with the electrically conductive element. The electrically conductive element may be comprised by a portion of the body. However, it is preferred for the electrically conductive element to be formed of a material which is resistant to corrosion in order to ensure that a good electrical contact is maintained. The electrically conductive element may take the form of an element which is secured in electrical connection with the body or may take the form of a rivet which is electrically insulated from the body but which is in electrical connection with a terminal disposed externally of the body.

An embodiment of the present invention will now be described, by way of example, with reference to the accompanying drawings, in which.

Figure 1:
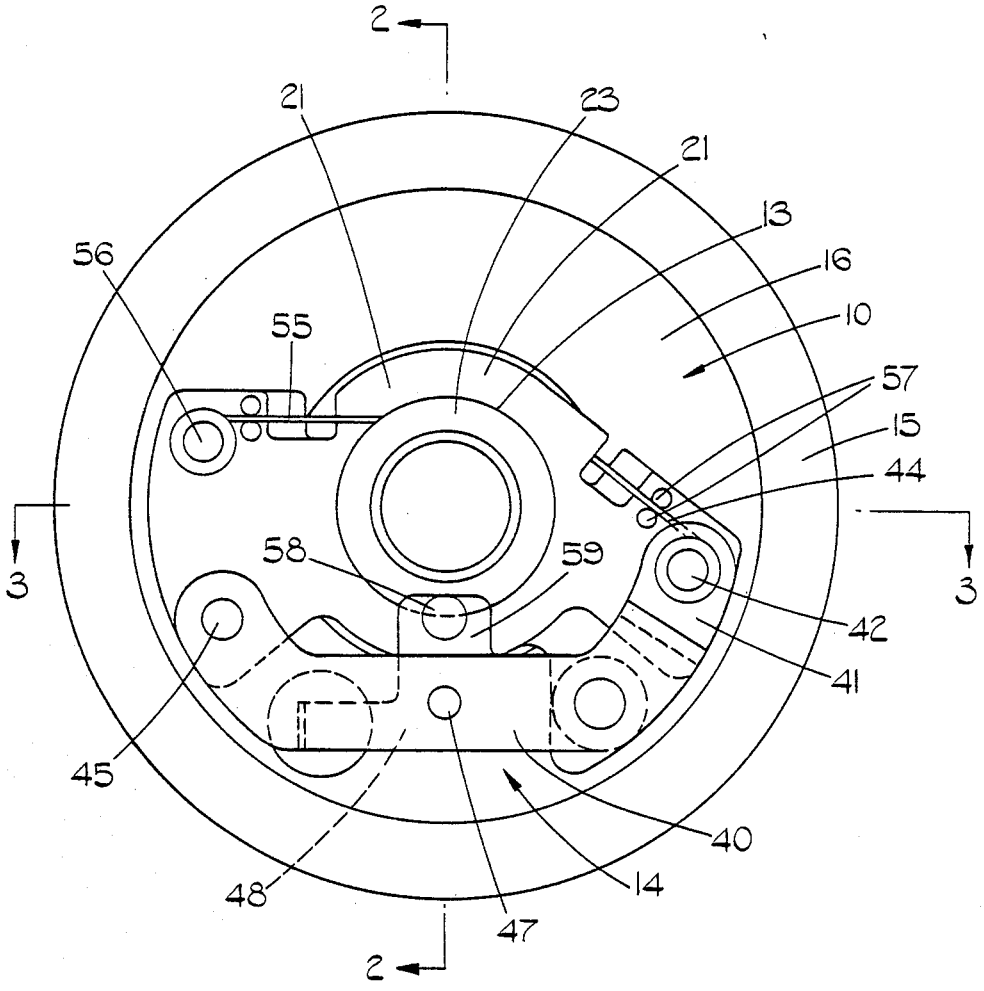
FIG. 1 is a plan view of an electromagnetic horn shown with a diaphragm thereof removed.
Figure 2:
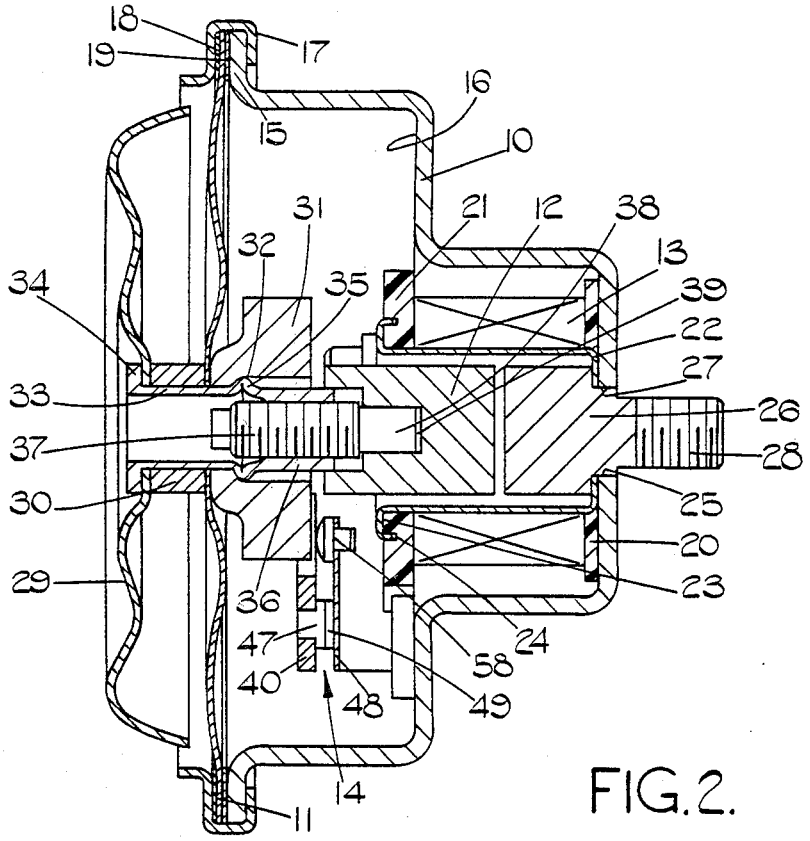
FIG. 2 is a section on the line 2—2 of FIG. 1.
Figure 3:
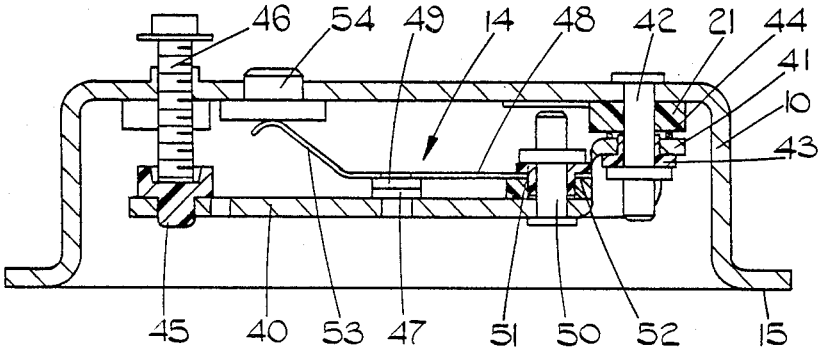
FIG. 3 is a split section on the line 3—3 of FIG. 1.

Referring now to the drawings, the electromagnetic horn comprises a dished body 10 formed of steel, a steel diaphragm 11, an armature 12, a coil 13 and a contact breaker assembly 14.

The body 10 is of circular cross-section and is stepped so as to provide an outer flange 15 around its opening, and an inner, annular mounting surface 16. The diaphragm 11 is secured around its outer periphery to the flange 15 by means of an annular clamp 17 which is crimped into position, there being provided a pair of annular, electrically insulating washers 18 and 19 between which the diaphragm 11 is clamped. The coil 13 is mounted at the end of the body 11 remote from the flange 15. One end of the coil 13 is disposed adjacent the base of the body 10 and is separated therefrom by an electrically insulating washer 20. The opposite end of the coil 13 lies in the same plane as the annular mounting surface 16 and is engaged by an electrically insulating moulding 21. The coil 13 is clamped in position by means of a cup-shaped aluminium retainer member 22 having an outwardly directed retaining flange 23 of hook shaped form engaging in an annular recess 24 in the moulding 21. At its otherwise closed end, the retainer member 22 has an aperture 25 therethrough which passes a shank portion of a core 26. The shank portion of the core 26 is a press fit in an aperture 27 in the body 10 and is screw threaded externally of the body 10 at 28. The screw-threading 28 is provided so as to enable the horn to be mounted on a motor vehicle body and also serves as an earth return as will be described hereinafter. It is to be appreciated that the core 26 is in electrical contact with the body 10. It will be appreciated from the above that the retainer member 22 is held securely between the core 26 and the base of the body 10 when the former is press fitted into the aperture 27.

A tone disc 29 is provided externally of the body 10 and is spaced from the diaphragm 11 by means of a spacing washer 30. Disposed on the opposite side of the diaphragm 11 to the tone disc 29 and washer 30 is a mass 31 of annular form. The internal surface of the annular mass 31 is stepped to provide an internal shoulder 32. The diaphragm 11, tone disc 29, spacer 30, and mass 31 are secured firmly together by means of a steel sleeve 33 having an outwardly projecting, integral flange 34 defining an abutment shoulder which is engaged with the outwardly directed surface of the tone disc 29. The sleeve 33 passes through aligned central openings in the tone disc 29, washer 30 and diaphragm 11 and also passes through the opening in the annular mass 31. The sleeve 33 has an outwardly projecting, upset annular rib 35 which is engaged against the internal shoulder 32 in mass 31. On the opposite side of the rib 35 to the flange 34, the sleeve 33 has an internally screw threaded portion 36 which is disposed, in part, externally of the mass 31. The assembly of diaphragm 11, washer 30, tone disc 29 and mass 31 is made by passing the sleeve 33 with the rib 35 as yet unformed through these components and then axially compressing the sleeve 33 so as to deform it intermediate its ends whereby the ribs 35 is produced. This action securely clamps together the parts 11, 29, 30, 31 and 33. This part of the assembly operation is effected before the diaphragm 11 is secured relative to the body 10 by means of the previously described clamp 17. An externally screw threaded rod 37 is engaged with the screw threaded portion 36 of the sleeve 33 and has an inner end portion 38 which is a press fit in a stepped bore 39 in the armature 12. The outer end of the stepped bore 39 has a greater diameter than the outer diameter of the screw-threaded portion 36 of the sleeve 33. The assembly of rod 37 and armature 12 is attached to the sleeve 33 before the diaphragm 11 is secured in position relative to the body 10 by the clamp 17.

It will be appreciated from the above that the position of the armature 12 relative to the body 10 and therefore relative to the core 26 can be adjusted by rotation of the rod 37 in view of the engagement of the latter with the screw threaded portion 36. Thus, the required air gap between the core 26 and the armature 12 can be set by appropriate adjustment of the rod 37. This is effected immediately upon assembly of the horn in the factory. The rod 37 can be retained against subsequent movement by using a thread locking composition whereby unwanted rotation of the rod 37 is prevented in spite of the vibrations to which the diaphragm assembly is subjected in use. In a modification (not shown) the portion 36 of the sleeve 33 is not actually internally screw-threaded and the rod 37 is provided with self-tapping thread form thereon so that the act of screwing the rod 37 into the portion 36 causes threads to be cut in the portion 36. This form of arrangement obviates the need to provide a thread locking composition as a sufficiently tight fit will be provided between the rod 37 and portion 36 to prevent rotation of the former in service. The above-described arrangement is extremely simple and lends itself ideally to automated production and automated setting of the air gap between the armature 12 and core 26.

The contact breaker assembly is also extremely easy to manufacture and assemble as will be apparent from the following description.

The contact breaker assembly 14 comprises a first electrically conductive arm 40 which is relatively rigid. The arm 40 is cranked at one end 41 thereof and is secured at this end to the body 10 by means of a rivet 42. However, the first arm 40 is maintained in electrical isolation from the body 10 because of the provision of an electrically insulating brush 43 which electrically insulates the cranked portion 41 of the arm 40 from the rivet 42. The cranked portion 41 of the arm 40 is separated from the body 10 by a part of the electrically insulating moulding 21. An electrical lead 44 from one end of the coil 13 is trapped between the moulding 21 and the cranked portion 41 of the arm 40 so as to connect said one end of the coil 13 electrically with the arm 40. The opposite end of the arm 40 to the portion 41 has an electrically insulating bush 45 which receives the free end of an adjusting screw 46 engaged in a screw threaded manner with the body 10. Rotation of the screw 46 in a clockwise direction lifts the arm 40 by resiliently deforming it about the cranked portion 41. Rotation of the screw 46 in the anti-clockwise direction allows the first arm 40 to flex downwardly under its own resilience. The first arm 40 carries a tungsten contact 47 intermediate its ends. The contact breaker assembly 14 further comprises a second arm 48 carrying a second contact 49 intermediate its ends. The second contact 49 is normally engaged with the first contact 47 when the coil 13 is de-energised. The second arm 48 is more resilient than the first arm 40 and, at one of its ends, is mounted on the latter by means of a rivet 50. An electrically insulating bush 51 and a washer 52 maintain the second arm 48 in electrical isolation from the rivet 50 and the first arm 40. At its opposite end, the second arm 48 is extended beyond the second contact 49 to define an integral, cranked, resilient contact blade 53 which is engaged with a contact stud 54 press fitted into the body 10. In a modification, contact stud 54 is replaced by a rivet engaged by the blade 53, the rivet being electrically insulated from the body 10 and also serving to secure a terminal disposed externally of the body 10. This form of arrangement is provided in the case where it is not desired to connect the second arm 48 electrically with the body 10. In the present embodiment, however, a lead 55 (see FIG. 1) extends to and is trapped by a rivet 56 to which is also secured a terminal (not shown) disposed externally of the body 10. The rivet 56 passes through an electrically insulating bush (also not shown) mounted in the body 10 and serving to insulate the rivet 56 from the body 10.

With the above form of contact breaker assembly, the second arm 48 can be mounted on the first arm 40 before the latter is mounted in the body 10. This considerably simplifies manufacture, particularly since a relatively few number of separate parts have to be manipulated at the time when the assembly is actually mounted in the body 10. During such assembly, it is merely necessary to ensure that the lead 44 is in the correct position and this is simplified by the provision of a pair of upstanding integral posts 57 on the insulating moulding 21. The lead 44 is fed between the posts 57 which retain it temporarily in position. The arm 40, with the second arm 48 and the bush 43 previously mounted thereon is then inserted over the rivet 42 so as to trap the lead 44 and then the usual deforming operation is effected on the rivet 42 to hold the complete contact breaker assembly in position. It will be appreciated that, during mounting of the complete contact breaker assembly 14 in the body 10, the blade portion 53 will be brought into engagement with the contact stud 54.

The second arm 48 has a lateral extension 59 carrying an electrically insulating top 58 which is disposed in the path of movement of the mass 31.

In use, the above described electromagnetic horn is mounted on the vehicle body with the screw threaded portion 28 of the core 26 in electrical connection therewith. The terminal associated with the rivet 56 is connected to the electrical supply and so the circuit to the coil 13 is completed via the lead 44, the first arm 40, the first contact 47, the second contact 49, the second arm 48, the contact stud 54, and the body 10. Energisation of the coil 13 causes attraction of the armature 12 and movement of the diaphragm 11 and mass 31. Movement of the mass 31 in the direction of the coil 13 causes the contacts 47 and 49 to be separated because of engagement of the mass 31 with the stop 58 which deflects the intermediate portion of the second arm 48. This interrupts the supply of current to the coil 13 and so permits the armature 12 to move in the opposite direction under the action of the diaphragm 11 which has a certain inherent resilience. This causes the mass 31 to disengage from the stop 58 and so permit the contacts 47 and 49 to close and re-establish the current supply through the coil 13. Adjustment of the position of the stop 58 relative to the mass 31 is effected by appropriate rotation of the adjusting screw 46. This increases or decreases the electrical current consumed.

In a modification (not shown), the electromagnetic horn has the mass formed integrally with or secured directly to the armature and is connected with the diaphragm via the screw-threaded rod and the sleeve. In such a modification, the sleeve is rather shorter than the sleeve 33 described above since its retaining rib, produced by deforming the sleeve, is engaged either directly against the diaphragm or against a load spreading washer on the undersurface of the diaphragm.

We claim:

1. An electromagnetic horn comprising a hollow body, an electrical coil mounted in said body, an armature extending into said coil, a screw-threaded rod extending from said armature, a diaphragm secured around the periphery thereof to said body and having means defining a central aperture, a mass having means defining an aperture therethrough in alignment with the aperture in said diaphragm, a sleeve extending through said apertures in said diaphragm and said mass, said sleeve having an external, laterally projecting abutment shoulder at one end thereof, said sleeve having securing means securing said diaphragm and said mass together by clamping diaphragm and said mass between said abutment shoulder and said securing means, and said screw-threaded rod being screw-engaged in said sleeve so that adjustment of said armature relative to said coil for air gap-setting purposes can be effected by rotation of said screw-threaded rod.

2. The electromagnetic horn according to claim 1, further comprising a tone disc and a spacer mounted on said sleeve between said abutment shoulder and said diagphram.

3. The electromagnetic horn according to claim 1, wherein said securing means comprises a portion of said sleeve which is deformed outwardly of said sleeve to retain diaphragm and mass thereon.

4. The electromagnetic horn according to claim 3, wherein said portion of said sleeve which is deformed outwardly of said sleeve defines an external annular rib.

5. An electromagnetic horn comprising a hollow body, an electrical coil mounted in said body, an armature mounted in said body, a diaphragm connected with said armature for movement thereby, and a contact breaker assembly mounted in said body, said contact breaker assembly comprising first and second contacts, a first electrically conductive arm, (a) said first arm being secured at one of its ends to said body and electrically insulated thereform, (b) an adjuster engaging said first arm at its other end, (c) said first arm having an intermediate portion carrying said first contact, and (d) said first arm being electrically connected with one end of said coil, and a second electrically conductive arm, (a) said second arm being mounted on said first arm and electrically insulated therefrom, (b) said second arm carrying said second contact, (c) said second arm being arranged to flexed during movement of said armature to move said second contact relative to said first contact, and (d) said second arm being provided with an extension which is resiliently urged into engagement with an electrically conductive element fixed relative to said body whereby an electrical circuit through said coil is completed through said electrically conductive element and said extension of said second arm.

6. The electromagnetic horn according to claim 5, wherein said electrically conductive element is an element which is secured in electrical connection with the body.

7. The electromagnetic horn according to claim 5, wherein said first electrically conductive arm has a cranked portion at said one of its ends and said second electrically conductive arm is mounted on said first electrically conductive arm adjacent said cranked portion.

8. The electromagnetic horn according to claim 5, wherein said first arm is electrically connected with said one end of said coil by an electrical lead which is trapped between said first arm and an electrically insulating member insulating said first arm from said body.

* * * * *